US006119763A

United States Patent [19]

Inoue et al.

[11] Patent Number: 6,119,763

[45] Date of Patent: Sep. 19, 2000

[54] METHOD FOR PREPARING GOLF BALL MOLD

[75] Inventors: Michio Inoue; Keisuke Ihara, both of Chichibu, Japan

[73] Assignee: Bridgestone Sports Co., Ltd., Tokyo, Japan

[21] Appl. No.: 09/173,691

[22] Filed: Oct. 16, 1998

[30] Foreign Application Priority Data

Oct. 16, 1997 [JP] Japan ..... 9-299580

[51] Int. Cl.[7] ..... B22C 9/00; B22C 7/00

[52] U.S. Cl. ..... 164/516; 164/519; 164/35; 164/45

[58] Field of Search ..... 164/516, 34, 35, 164/45, 517, 518, 519

[56] References Cited

U.S. PATENT DOCUMENTS 4,617,977 10/1986 Mills ..... 164/34

5,507,336 4/1996 Tobin ..... 164/34

5,840,351 11/1998 Inone et al. ..... 425/556

*Primary Examiner*—Harold Pyon

*Assistant Examiner*—I.-H. Lin

*Attorney, Agent, or Firm*—Sughrue, Mion, Zinn, Macpeak & Seas, PLLC

[57] ABSTRACT

A golf ball mold is prepared by inserting a dimpled hemispherical male die into a chamber in a frame, admitting hot liquid wax into the chamber, cooling and curing the wax to form a wax shape, covering the wax shape with a mix slurry of ceramic particles and a binder, drying and curing the slurry to form a ceramic shell around the wax shape, removing the wax shape from the ceramic shell, casting a molten metal into the ceramic shell, cooling and solidifying the metal to form a mold half, and removing the ceramic shell from the mold half. The mold is improved in molding precision, durability and cost.

9 Claims, 6 Drawing Sheets

METHOD FOR PREPARING GOLF BALL MOLD

BACKGROUND OF THE INVENTION

1. Field of the Invention

This invention relates to a method for preparing a golf ball mold having improved molding precision and durability at a reduced cost; a golf ball mold which has been prepared by the method; and golf balls molded using the mold.

2. Prior Art

Molds designed to mold golf balls are well known in the art. Most commonly used are golf ball molds of the split type wherein a spherical cavity is internally defined by their internal wall surface having a plurality of projections for forming dimples on a golf ball (referred to as dimple-forming projections). The mold is divided into two mold halves along a parting plane substantially coplanar with the equator of the cavity.

Traditional methods for preparing golf ball molds include hobbing, precision casting, electric discharge machining, and electroforming. In the hobbing technique, a thin sheet metal is interposed between a hemispherical master male die or hob (or base pattern) having a plurality of dimples in its surface and a female die adapted to receive the male die, the hob is pressed into the sheet metal to shape the sheet metal, and the shaped sheet metal is set in a hemispherical recess in a mold base. Alternatively, a mold base of relatively mild metal having a recess is furnished and the hemispherical master male die or hob is directly pressed against the recess of the mold base for shaping the mold.

In the precision casting technique, silicone rubber is applied to the surface of the master male die, followed by vulcanization to form a female die. The female die is filled with a ceramic material to form a ceramic male die. Thereafter, a frame is formed around the ceramic male die from a ceramic material such that the ceramic male die is located inside the frame and a cavity corresponding to the outside configuration of a desired mold is defined in the frame. Molten metal is cast into the cavity through a gate on the frame and cooled therein. Removal of the surrounding ceramic portions including the male die and frame leaves the mold.

The electric discharge machining technique involves placing a male die close to a female die having a ball-shaped recess with a smooth surface, and generating an electric discharge therebetween, thereby forming dimple-forming projections on the recess surface of the female die.

In the electroforming technique, a thick plating layer, for example, using nickel is formed on the surface of a male die by a plating process. The plating layer is removed from the male die and used as a patterning portion of a mold.

The hobbing technique is advantageous in cost, but is limited in the precision of the ball molding surface because the molding surface is formed of a thin sheet metal or relatively mild metal. Durability is poorest among the aforementioned techniques. Precision cast molds are improved in molding precision and durability, but expensive due to the complication of the process. The molds formed by electric discharge machining are highly durable, but low in molding precision. The cost is high because a master male die must be furnished for every mold. Electroformed molds are improved in molding precision and durability, but cannot avoid an increased cost because a master male die must be furnished for every mold as in the case of electric discharge machining.

As described above, the traditional methods for preparing golf ball molds have advantages and disadvantages. There is a desire to have a method for preparing a mold which is improved in all of molding precision, durability and cost.

SUMMARY OF THE INVENTION

An object of the invention is to provide a method for preparing a golf ball mold which is improved in all of molding precision, durability and cost.

According to the invention, there is provided a method for preparing a golf ball mold defining therein a spherical cavity by its internal wall surface having a plurality of projections for forming dimples on a golf ball, the mold being divided into two mold halves along a parting plane substantially coplanar with the equator of the cavity. In a first embodiment of the invention, the method involves a wax shape forming step, a ceramic shell forming step, a mold casting step, and ceramic shell removing step. The wax shape forming step includes furnishing a frame defining a hollow wax chamber and having a feed channel communicating with the chamber and a male master provided at one end with a hemispherical male die having a plurality of dimples in its surface, inserting the hemispherical male die into the chamber, admitting hot liquid wax into the chamber through the feed channel, cooling and curing the wax to form a wax shape. The ceramic shell forming step includes taking the cured wax shape out of the frame, removing the wax portion cured in the feed channel from the wax shape, covering the wax shape with a mix slurry of ceramic particles and a binder to a predetermined thickness while leaving uncovered a portion serving as a gate, drying and curing the slurry to form a ceramic shell around the wax shape. The mold casting step includes melting and liquefying the wax shape within the cured ceramic shell, discharging the liquefied wax from the ceramic shell through the gate to thereby leave a corresponding space within the ceramic shell, casting a molten metal into the space in the ceramic shell through the gate, cooling and solidifying the metal to form a mold half within the ceramic shell. Finally, the ceramic shell is removed from the cast mold half.

Preferably, at least of those dimples located on the hemispherical male die near the equator have an edge angle of up to 30°. The ceramic particles in the mix slurry typically have a particle size of #100 to #1000 mesh.

In a second embodiment of the invention, the wax shape forming step includes furnishing a male master dummy provided at one end with a hemispherical male die dummy having a shape conformal to the hemispherical male die and a size larger than the hemispherical male die, but free of dimples in its surface, inserting the hemispherical male die dummy instead of the hemispherical male die into the hollow wax chamber, admitting hot liquid wax into the chamber through the feed channel, cooling and curing the wax to form a wax preform, replacing the male master dummy by the male master, a gap being defined between the hemispherical male die and the wax preform, admitting hot liquid wax into the gap, cooling and curing the wax to form a wax shape.

Also contemplated herein are a golf ball mold which has been prepared by the method of the invention and a golf ball which has been molded using the mold.

The invention provides for the preparation of a golf ball mold which is improved in molding precision, especially dimple precision (that is, transfer precision of dimple shape) and sphericity, durability, especially durability of a male master (or base pattern), and cost.

According to the first embodiment of the invention, since hot liquid wax which is a smoothly flowing inexpensive material is used, a wax shape faithfully and accurately reproducing the geometrical configuration of a male master can be formed without damage to the expensive male master. Since the wax shape is then covered with a mix slurry of ceramic particles and a binder, which is easy to handle, a ceramic shell faithfully and accurately reproducing the geometrical configuration of the wax shape can be formed. Using the ceramic shell as a casting mold, a golf ball mold having a high dimple precision can be prepared at low cost.

In the second preferred embodiment of the invention, the use of a male master dummy is effective for preventing any loss of sphericity which is otherwise caused by shrinkage of the wax shape due to the varying thickness thereof. A further improvement in molding precision is achieved.

Since the geometrical configuration of the male master as the base pattern is faithfully and accurately transferred to the golf ball mold, golf balls of quality having a high sphericity and little or no variation in dimple shape can be produced at a low cost.

These and other objects, features, and advantages of the invention will be better understood by reading the following description taken in conjunction with the accompanying drawings.

DETAILED DESCRIPTION OF THE INVENTION

First Embodiment

Figure 1:
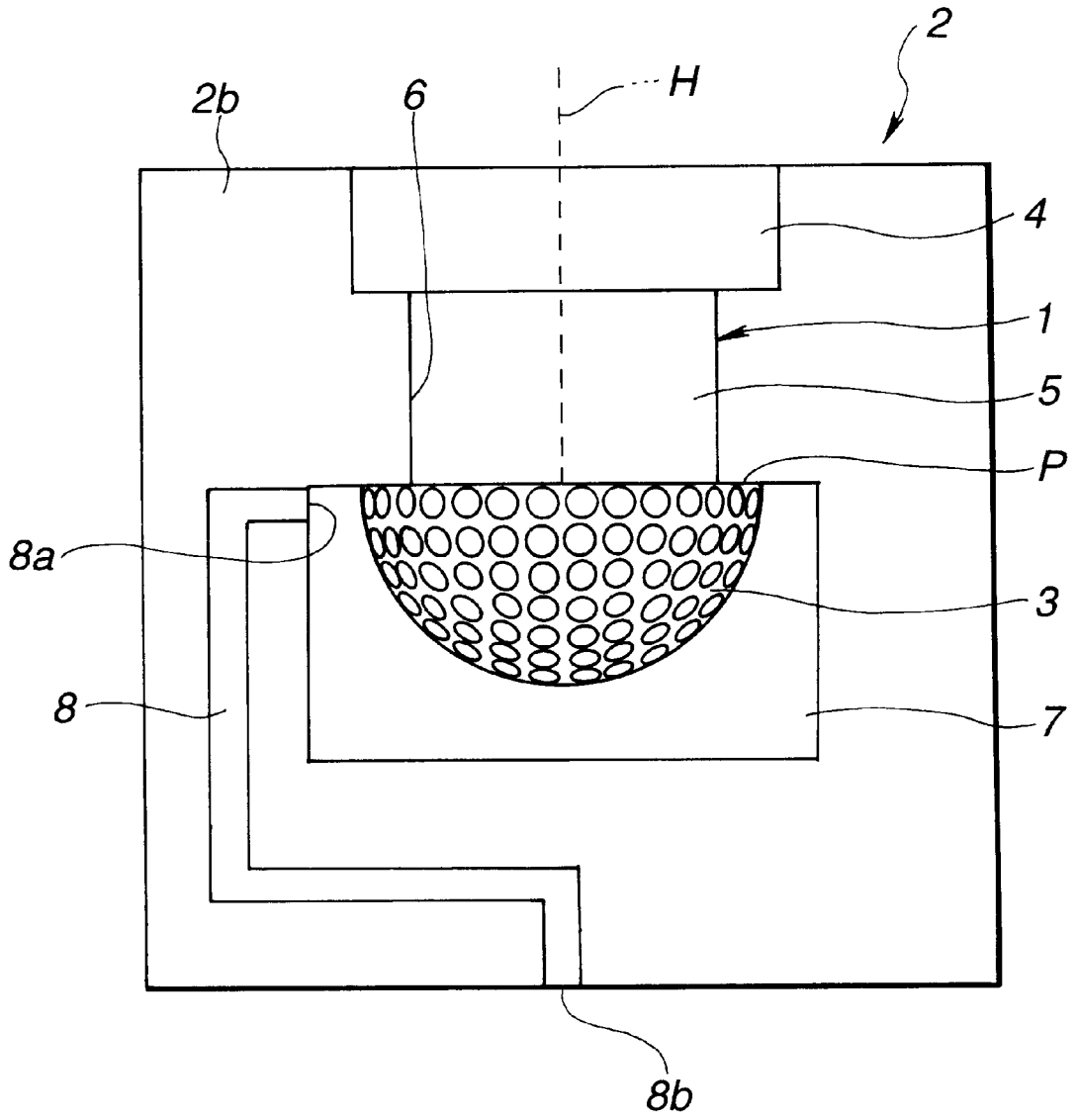
FIG. 1 is a side elevation of a male master and a frame for preparing a golf ball mold according to the first embodiment of the invention.

FIGS. 1 to 6 illustrate the method for preparing a golf ball mold according to the first embodiment of the invention. First referring to FIG. 1, there are illustrated a male master 1 and a frame 2 for preparing a golf ball mold according to the invention. The male master 1 includes a hemispherical male die 3 having a plurality of dimples in its surface at one end, a dilated root 4 at another end, and a cylindrical intermediate shank 5 with a relatively small diameter connecting the male die 3 and the dilated root 4. The hemispherical male die 3 has an edge P which is coincident with the equator of a corresponding sphere. The male master 1 is disposed in the frame 2 such that the hemispherical male die 3 may face downward with its equator P above.

Although the hemispherical male die 3 of the male master is illustrated exactly as a hemisphere, the hemispherical male die 3 is preferably provided with a cylindrical rim extending upward from the upper edge of the die (coincident with the equator P) and having the same diameter as the upper edge and a vertical distance of about 0.1 to 5 mm. The rim is formed in order to provide a grinding allowance for machining the parting surface of a finally cast mold.

In the illustrated embodiment, the frame 2 includes a pair of front and rear frame sections 2*a* and 2*b* which are removably mated along a plane parallel to a center axis H of the male master 1 (and also parallel to the plane of the drawing sheet). In FIG. 1, only the rear frame section 2*b* is shown, with the front frame section removed.

When the front and rear frame sections 2*a* and 2*b* are mated, the frame 2 defines therein a bore 6 for receiving the male master 1 and a hollow wax chamber 7 in communication with the bore 6. The male master 1 is disposed in the frame 2 such that the dilated root 4 and the shank 5 fit in the bore 6 and the hemispherical master die 3 is positioned within the chamber 7. Defined in the chamber 7 is a space having substantially the same shape as the mold half to be produced (which may be either an upper mold half or a lower mold half). The upper edge or equator P of the hemispherical male die 3 is flush with the upper surface of the wax chamber 7. The frame 2 further has a wax feed channel 8 having an outlet 8*a* at one end in communication with the wax chamber 7 and a wax inlet 8*b* at another end. Preferably the outlet 8*a* of the channel 8 is open near the upper end of the wax chamber 7 and hence, near the equator P of the hemispherical male die 3. This is because when hot liquid wax is injected into the chamber 7 through the channel 8, the wax can be more fully packed so that a more dense or precise wax shape may be formed. While not shown, a means for injecting hot liquid wax is connected to the inlet 8*b* of the channel 8. The configuration, length and inner diameter of the channel 8 may be determined as appropriate to achieve the objects of the invention.

It is noted that the bore 6 in the frame 2 is configured in close conformity to the cylindrical shank 5 and the dilated root 4 of the male master 1. In particular, the intermediate bore portion adapted to receive the cylindrical shank 5 is configured to the hourglass shape that a center portion is narrowed to a slightly smaller diameter than opposite end portions as viewed in the direction of axis H of the male master 1. This ensures that when a pair of front and rear frame sections are removably mated to complete the frame, the male master 1 is positioned within the bore 6, and the hemispherical male die 3 of the male master is accurately positioned at the center of the wax chamber 7.

Reference is now made to the dimples formed in the surface of the hemispherical male die 3 of the male master 1. In the present invention, the diameter, depth, and edge angle of a dimple are defined as follows.

Dimple Diameter

Figure 2:
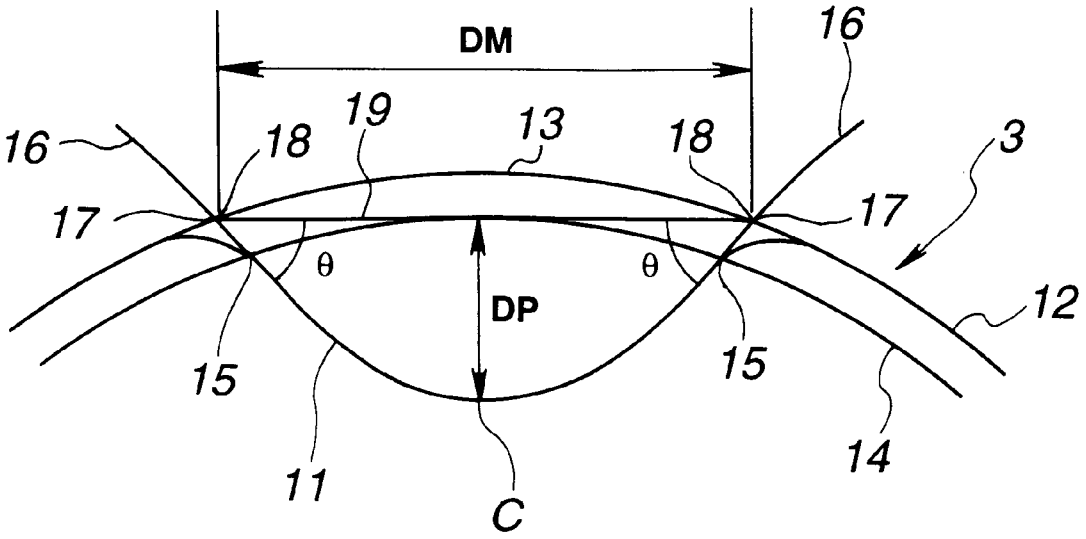
FIG. 2 diagrammatically illustrates a dimple formed in the surface of a male die of the male master.

The cross-section of FIG. 2, viewed radially with respect to the ball center, passes the center C of a dimple 11. A land surface contour curve 13 consisting of the land 12 surface and an imaginary extension thereof (representing an imaginary spherical surface having the diameter of the ball) and an imaginary curve 14 spaced 0.04 mm inside from the contour curve 13 (or spherical surface having a radius 0.04 mm smaller than the ball radius) are drawn in conjunction with the dimple 11. The inside curve 14 intersects the dimple 11 at two points 15. The tangents 16 to the dimple 11 at these points 15, extended outward, intersect the contour curve 13 at reference points 17. The length DM of a straight line segment between reference points 17 and 17 is the diameter of the dimple.

Dimple Depth

In FIG. 2, a series of reference points 17 defines a circumference or dimple edge 18. The dimple edge 18 circumscribes a plane 19 which is a circle having the diameter DM. The length DP of a normal line segment extending from the plane 19 to the center C of the dimple is the depth of the dimple.

Edge Angle

The edge angle is, as shown in FIG. 2, the angle θ between the tangent 16 at intersection 15 and the straight line segment between reference points 17 and 17 (or plane 19 circumscribed by dimple edge 18).

Described below is the method for preparing a golf ball mold by starting with the male master and the frame described above.

Briefly stated, the method of the invention involves the step of forming a wax shape, the step of forming a ceramic shell, the step of casting a mold, and the step of removing the ceramic shell.

(1) Wax Shape Forming Step

After the male master 1 is fitted in the front or rear frame section, the front and rear frame sections are joined together. Then hot liquid wax is injected into the wax chamber 7 through the feed channel 8 from its inlet 8*b* to the outlet 8*a*. The wax is then cooled and cured in the chamber 7 to form a wax shape 20 (see FIG. 3). Preferred examples of the wax used herein include rosin, petroleum resin, carnauba wax, and montan wax. Waxes having a melting point of 50 to 100° C. are preferred.

Figure 3:
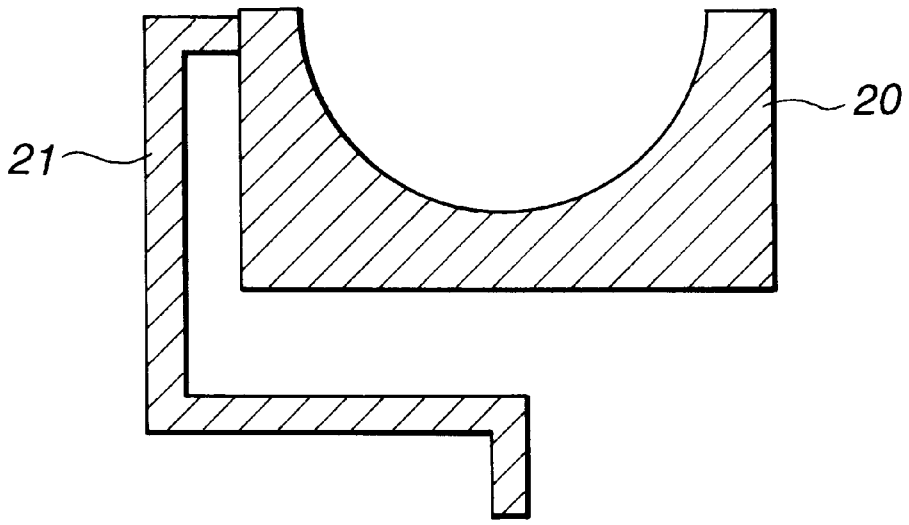
FIG. 3 is a cross-sectional view of a wax shape with an extra portion cured in a channel.
Figure 4:
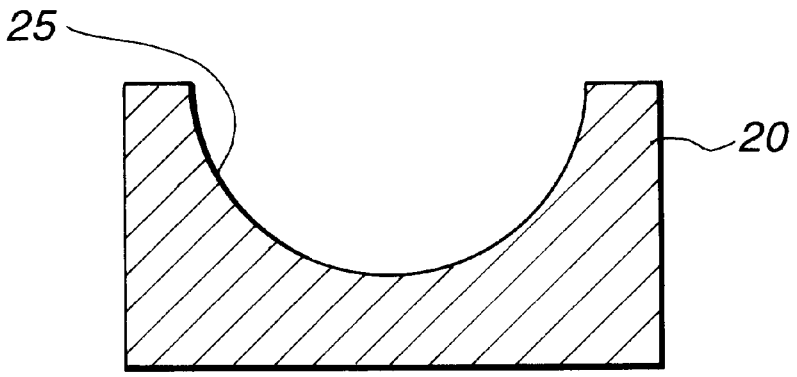
FIG. 4 is a cross-sectional view of the wax shape.

The frame 2 is then opened, the wax shape 20 as cured is taken out of the chamber 7 together with the male master 1. The male master 1 is separated from the wax shape 20. At this point, the wax shape 20 has attached thereto an extra wax portion 21 which has cured in the channel 8 as shown in FIG. 3. The extra wax portion 21 is removed, leaving the wax shape 20 as shown in FIG. 4, that is, a wax female mold corresponding to a half of a split golf ball mold (which may be either an upper or a lower mold half). Though not shown, the hemispherical concave surface 25 of the wax shape 20 is formed with a plurality of projections (dimple-forming projections) which faithfully and accurately reproduce in a negative manner the dimples in the surface of the hemispherical male die 3 of the male master 1. Differently stated, the dimples on the male die 3 are transferred to the concave surface 25 of the wax shape 20.

Given the step of separating the male master 1 from the wax shape 20 in the direction of axis H of the male master 1 (see FIG. 1), it is preferred that at least those dimples located on the hemispherical male die 3 near the equator P, preferably all the dimples on the hemispherical male die 3, have an edge angle θ of not more than 30°, especially from 0.1° to 10°. The adjustment of the edge angle θ of the dimples on the male die surface within the range allows the male master to be smoothly separated from the wax shape without damaging the dimple-forming projections on the wax shape, yielding the wax shape having the dimple pattern transferred thereto at a high precision. It is preferred that the dimples on the hemispherical male die 3 have a diameter DM of 4.2 mm at maximum, especially 3.0 to 4.2 mm and a depth DP of 0.1 to 0.35 mm.

Since hot liquid wax, characterized by good flow and low cost, is used for the transfer of the dimple pattern on the male master, the geometrical configuration of the hemispherical male die of the male master which is a unique hemisphere having a plurality of dimples in its surface can be faithfully and accurately transferred at low cost without damage to the male master. This allows for repetitive use of the expensive male master. The service life of the male master is improved, achieving a reduction of the manufacturing cost. Additionally, the positional adjustment of the outlet of the channel 8 and the adjustment of the edge angle of the dimples on the hemispherical male die within the above-defined range are effective for minimizing the possibility of damage during the step of separating the wax shape from the male die.

(2) Ceramic Shell Forming Step

Figure 5:
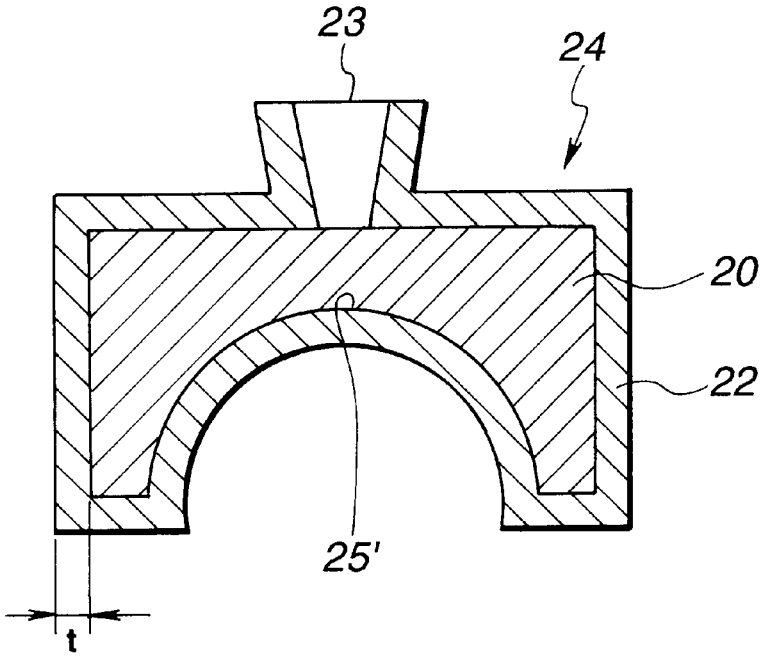
FIG. 5 is a cross-sectional view of the wax shape covered with a mix slurry.

As shown in FIG. 5, the wax shape 20 is covered with a mix slurry of ceramic particles or sand and a binder to a predetermined thickness while leaving uncovered a portion serving as a gate or opening 23. The slurry is then dried and cured on the wax shape to form a ceramic shell 24 with the gate 23 around the wax shape 20. The dry thickness t of the mix slurry or ceramic wall 22 is usually about 5 to 20 mm, preferably about 8 to 15 mm. The position of the gate or opening 23 in the shell 24 is not particularly limited although the gate 23 is positioned on the side of the wax shape 20 opposite to the hemispherical concave surface 25. Two gates may be provided if desired.

In the mix slurry covering the wax shape, the ceramic particles have a particle size of #100 to #1000 mesh. Particularly when a product having a low surface roughness is finally to be cast, it is recommended to use a slurry containing ceramic particles of less than #500 mesh in an area presenting the molding surface.

Figure 6:
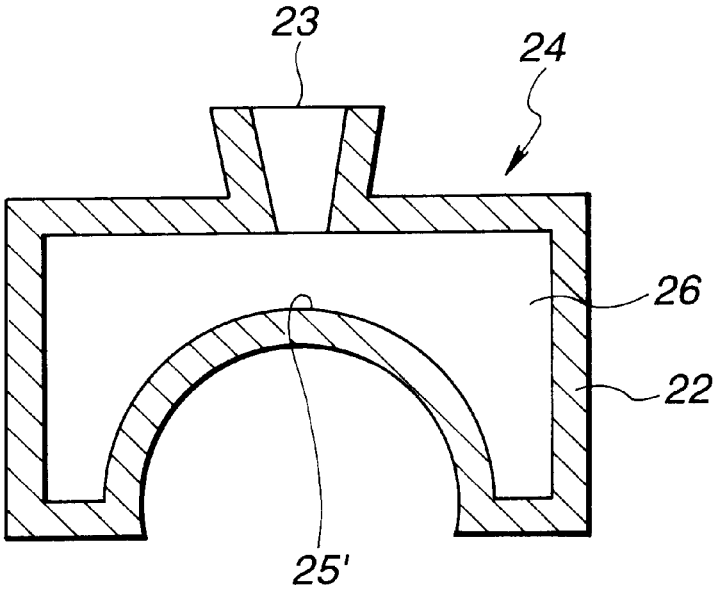
FIG. 6 is a cross-sectional view of a ceramic shell.

The cured ceramic shell or sand mold 24 with the wax shape 20 inside is then heated above the melting point of the wax, thereby melting and liquefying the wax shape 20 within the ceramic shell 24. The liquefied wax is fully discharged from the ceramic shell 24 through the gate 23. There is left the ceramic shell 24 having an empty space 26 corresponding to the mold half (either upper or lower mold half) as shown in FIG. 6. Though not shown, the inside surface of the ceramic shell 24 defining the space 26, especially, the inside surface portion 25' corresponding to the hemispherical concave surface 25 of the wax shape 20 is formed with dimples which faithfully and accurately reproduce the dimple-forming projections on the wax shape, which in turn, faithfully and accurately reproduce the dimples on the hemispherical male die of the male master.

The thus obtained ceramic shell 24 serves as a mold for casting a mold half (either upper or lower mold half).

(3) Casting Step

The ceramic shell 24 is used as a mold. A predetermined amount of molten metal is cast into the space 26 in the ceramic shell 24 through the gate 23 until the space 26 is filled with the molten metal. The molten metal is cooled and solidified to form a mold half within the ceramic shell. This mold half faithfully and accurately reproduces the geometrical configuration of the inside surface of the ceramic shell. Since the metal filling the space constitutes the mold half of the golf ball mold, a choice may be made of the metal materials commonly used in conventional golf ball molds, for example, iron, iron alloys, beryllium copper, aluminum and aluminum alloys.

(4) Ceramic Shell Removing Step

At the end of casting, the ceramic shell is removed. Means for removing the ceramic shell is not limited. For example, a ultrasonic wave generator is operated to apply ultrasonic vibrations to the ceramic shell, thereby breaking away the ceramic shell.

The thus obtained mold half is cleaned. The mold half is subject to surface treatment by sand blasting of #100 mesh alumina, if desired. It is understood that a boss formed on the mold half at the position of the gate is removed as by grinding.

The mold half is then subject to necessary working, for example, working of a parting surface, gates, runner, support pin holes, and spew when the mold is designed for injection molding. The mold half of the golf ball mold is completed in this way.

Another mold half is prepared by the same method and combined with the one mold half to complete the golf ball mold of the split type.

Second Embodiment

Figure 7:
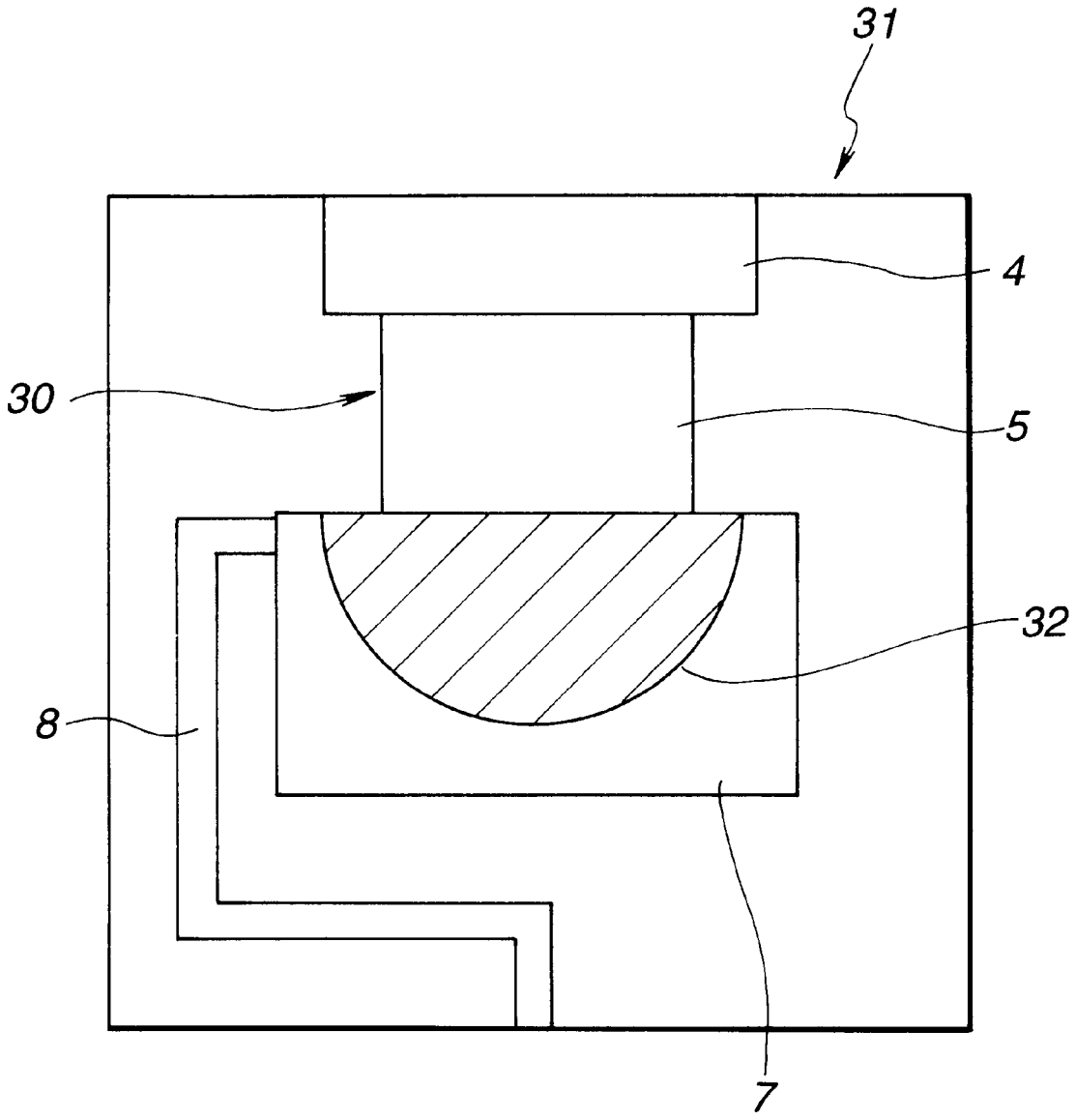
FIG. 7 is a side elevation of a male master dummy and a frame for preparing a golf ball mold according to the second embodiment of the invention.

FIG. 7 is a side elevation of a male master dummy 30 and a frame 31 for preparing a golf ball mold according to the second embodiment of the invention. For the male master dummy 30 and frame 31, the same components as in the first embodiment are designated with the same numerals and their description is omitted.

The feature of the second embodiment is an alteration of the wax shape forming step in the first embodiment. There are furnished a male master dummy 30 which is provided at one end with a hemispherical male die dummy 32 having a shape conformal to the hemispherical male die 3 of the male master 1 and a size larger than the hemispherical male die 3. Typically the male die dummy 32 is about 1 to 5 mm larger in diameter than the male die 3. In the second embodiment, this male master dummy 30 in FIG. 7 is used instead of the male master 1 in FIG. 1. The hemispherical male die dummy 32 is set in the hollow wax chamber 7 as in the first embodiment. Hot liquid wax is injected into the chamber 7 defined between the male die dummy 32 and the frame 31 through the feed channel 8, then cooled and cured to form a solid wax preform (33 in FIG. 8). In the second embodiment, no dimples are formed in the surface of the hemispherical male die dummy 32, that is, the hemispherical male die dummy 32 has a smooth convex surface. The cylindrical shank 5 and the dilated root 4 integrally formed with the hemispherical male die dummy 32 are of the same dimensions as in the male master 1 shown in FIG. 1. That is, the male master dummy 30 is the same as the male master 1 shown in FIG. 1 except that the hemispherical male die 3 is replaced by the hemispherical male die dummy 32.

Figure 8:
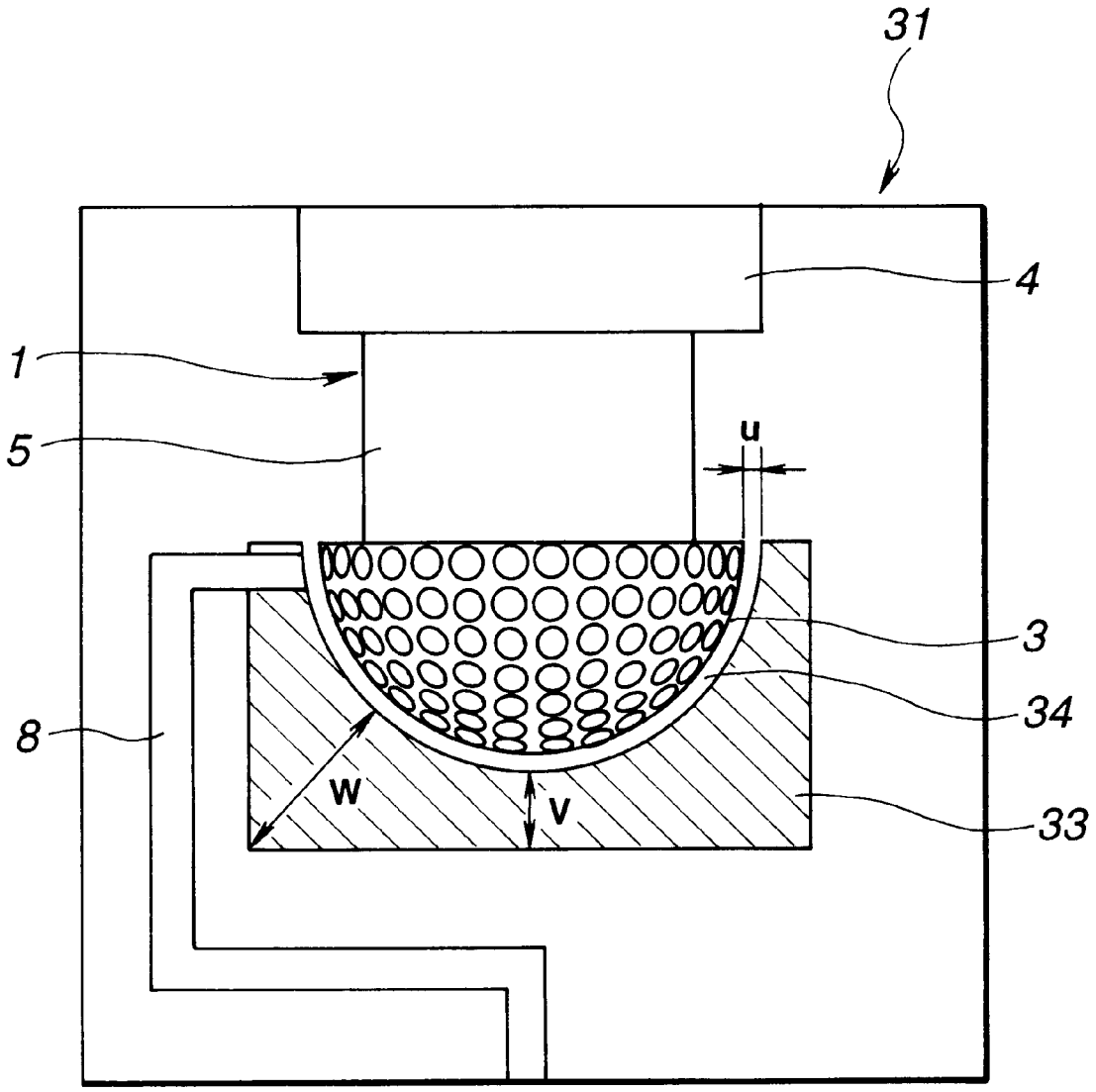
FIG. 8 is a side elevation showing the step of forming a wax shape.

Next, as shown in FIG. 8, the male master dummy 30 is replaced by the male master 1 having the male die 3 with the dimpled surface. A gap 34 is then defined between the hemispherical male die 3 and the solid wax preform 33. Hot liquid wax is injected into the gap 34, then cooled and cured to form a wax shape. The gap 34 usually has a distance u of about 1 to 5 mm. The channel for injecting hot liquid wax into the gap 34 is obtained by extending the existing channel 8 in the frame so as to reach the gap, for example, by burying a metal pipe in the solid wax shape 33 so as to communicate with the channel outlet.

Apparently the wax shape formed in the second embodiment is the same as the wax shape in the first embodiment although the wax shape in the second embodiment consists of the wax preform and the overlay. As compared with the first embodiment where the whole wax shape is formed at once, the second embodiment is effective for preventing the occurrence of shrinkage which is otherwise caused by the positional difference in thickness of the wax shape.

More particularly, the solid wax preform 33 has different thicknesses at different positions, for example, a center thickness V of 6 mm and a corner thickness W of 18 mm (W>V) as shown in FIG. 8. During cooling and solidification, shrinkage can occur due to the difference in coefficient of volume shrinkage. According to the second embodiment, after the solid wax preform is formed using the male master dummy, liquid wax is admitted into the gap between the solid wax preform and the male master to thereby form the wax shape. Since the overlay portion of the wax shape has a minimal difference in thickness and hence, a minimal difference in shrinkage factor during cooling, the occurrence of shrinkage can be prevented. A golf ball mold having further improved sphericity and precision is thus obtained.

The above-mentioned wax shape-forming step is followed by the ceramic shell forming step, casting step, and ceramic shell removing step as in the first embodiment, thereby producing a mold.

As described above, the method for preparing a golf ball mold according to the invention is improved in all of molding precision, durability and cost over the traditional methods. A mold of quality can be prepared through simple steps using materials that are inexpensive and easy to handle. Additionally, the male master or base pattern is least damaged and thus may be used repeatedly.

The golf ball mold prepared by the inventive method bears a faithful and accurate reproduction of the geometrical configuration of the male master or base pattern so that golf balls of quality having a high sphericity and least variation in dimple shape can be produced at a low cost.

Although the preferred embodiments of the invention have been described, the invention is not limited thereto. For example, instead of the working steps performed after the casting of a mold half, the male master may be previously provided with gates, runner, support pin holes, and spew. Other modifications and changes may be made without departing from the scope of the invention.

What is claimed is:

1. A method for preparing a golf ball mold defining therein a spherical cavity by its internal wall surface having a plurality of projections for forming dimples on a golf ball, the mold being divided into two mold halves along a parting plane substantially coplanar with the equator of the cavity, said method comprising the steps of:

furnishing a frame defining a hollow wax chamber having a feed channel communicating with the chamber and a male master provided at one end thereof with a hemispherical male die having a plurality of dimples in its surface, inserting the hemispherical male die into the chamber, so that the chamber has defined therein a space having substantially the same shape as the mold half to be produced, admitting hot liquid wax into the chamber through the feed channel, cooling and curing the wax to form a wax shape, taking the cured wax shape out of the frame, removing any wax portion cured in the feed channel from the wax shape, coving the wax shape with a mix slurry of ceramic particles and a binder to a predetermined thickness while leaving uncovered a portion serving as a gate, drying and curing the slurry to form a ceramic shell around the wax shape, melting and liquefying the wax from the ceramic shell through the gate to thereby leave a corresponding space within the ceramic shell, casting a molten metal into the space in the ceramic shell through the gate, cooling and solidifying the metal to form a mold half within the ceramic shell, and removing the ceramic shell from the case mold half.

2. The method of claim 1, wherein the step of forming a wax shape includes furnishing a male master dummy provided at one end with a hemispherical male die dummy having a shape conformal to said hemispherical male die and a size in the range of 1 to 5 mm larger than said hemispherical male die, but free of dimples in its surface, inserting the hemispherical male die dummy instead of said hemispherical male die into the hollow wax chamber, admitting hot liquid wax into the chamber through the feed channel, cooling and curing wax to form a wax preform, replacing the male master dummy by the male master, wherein a gap having a distance in the range of 1 to 5 mm which is defined between the hemispherical male die and the wax preform, admitting hot liquid wax into the gap, cooling and curing the wax to form a wax shape.

3. The method of claim 1, wherein at least those dimples located on the hemispherical male die near the equator have a dimple edge angle of up to 30° wherein the dimple edge angle is defined between a dimple wall's extension line passing the dimple edge and the plane circumscribed by the dimple edge.

4. The method of claim 1, wherein the frame is composed of a pair of front and rear frame sections which are removable mated along a plane parallel to a center axis of the male master.

5. The method of claim 1, wherein the hemispherical male die has an edge which is coincident with the equator of a corresponding sphere.

6. The method of claim 5, wherein the hemispherical male die is provided with a cylindrical rim extending upward from the edge of the die and having the same diameter as the edge and a vertical distance of 0.1 to 5 mm.

7. The method of claim 1, wherein the ceramic shell is removed from the cast mold half by applying ultrasonic vibrations.

8. The method of claim 1, wherein the mold half is surface treated by sand blasting after removing the ceramic shell.

9. The method of claim 1 wherein the ceramic particles in the mix slurry have a particle size of #100 to #1000 mesh.

* * * * *